United States Patent [19]

Vydrin et al.

[11] 4,263,796

[45] Apr. 28, 1981

[54] VACUUM ROLL MILL STAND

[76] Inventors: Vladimir N. Vydrin, ulitsa Timiryazeva 28, kv. 27, Chelyabinsk; Alexandr V. Krupin, ulitsa Vavilova 52,korpus 3, kv. 172, Moscow; Leonid A. Barkov, ulitsa K. Tsetkin 30a, kv. 13, Chelyabinsk; Vyacheslav N. Chernyshev, ulitsa Vinokurova 13, korpus 1, kv. 65, Moscow; Valery V. Pastukhov, ulitsa Stalevarov 28a, kv. 79, Chelyabinsk; Jury L. Zarapin, ulitsa Kosinskaya 18, korpus 3, kv. 264, Moscow; Pulatzhan S. Maxudov, ulitsa Metallurgov 9, kv. 4; Nikolai N. Sergeev, ulitsa Metallurgov 5, kv. 4, both of Chirchik Tashkentskoi oblasti; Eduard E. Osipov, ulitsa Krasnoarmeiskaya 12, kv. 26, Orekhovo-Zuevo Moskovskoi oblasti; Sergei F. Burkhanov, ulitsa Valovaya 4-2/44, kv. 38, Moscow, all of U.S.S.R.

[21] Appl. No.: 14,303

[22] Filed: Feb. 23, 1979

[51] Int. Cl.[3] ..... B21B 9/00; B21B 31/08

[52] U.S. Cl. ..... 72/38; 72/238

[58] Field of Search ..... 29/DIG. 44; 72/38, 238, 72/239, 244, 247, 248, 249

[56] References Cited

U.S. PATENT DOCUMENTS

| | | | |
|---|---|---|---|
| 2,120,539 | 6/1938 | Barth | 72/238 X |
| 2,150,248 | 3/1939 | Rosenbaum | 72/238 X |
| 2,901,932 | 9/1959 | Erdelyi | 72/38 |
| 3,257,835 | 6/1966 | Cofer et al. | 72/38 X |

FOREIGN PATENT DOCUMENTS

| | | | |
|---|---|---|---|
| 422780 | 9/1974 | U.S.S.R. | 72/38 |
| 442013 | 11/1974 | U.S.S.R. | 72/38 |

*Primary Examiner*—Ervin M. Combs
*Attorney, Agent, or Firm*—Steinberg & Raskin

[57] ABSTRACT

A vacuum roll mill stand comprises a housing closed at opposite sides with covers and having its interior brought in communication with a vacuum pumping means to thereby form a chamber adapted to accommodate chocks carrying workrolls geared through the intermediary of spindles to a drive. The chocks together with the workrolls are secured on one of the housing covers thereby forming a frame, the housing being annular in shape and arranged so as to have its geometrical axis coincident with the axis of rolling; the housing also being fitted with through openings adapted to receive the spindles together with vacuum seals.

7 Claims, 3 Drawing Figures

VACUUM ROLL MILL STAND

BACKGROUND OF THE INVENTION

The present invention relates to rolling mills and more in particular to a vacuum roll mill stand.

1. Field of the Invention

The invention is preferably used where high-quality articles of exceptional purity are manufactured in vacuum or in an inert atmosphere from metals and alloys highly active chemically and of low ductility, for example, such as those based on tungsten, molybdenum, titanium, niobium.

Though the articles from such metals and alloys are usually manufactured in small quantities, they may greatly vary in type, size and shape, which necessitates frequent roll adjusting and changing operations to be carried out during operating process.

2. Description of the Prior Art

For example, there are known in the art vacuum rolling mills in which the mill stand and various roll adjustment mechanisms, fittings and spindles are housed within a vacuum chamber, with the mill drive being positioned externally thereof.

In the rolling mills of this type a vacuum chamber has a relatively large volume, which necessitates employment of a powerful vacuum system. To carry out the roll readjustment or changing operation, the vacuum chamber should be dismounted, this being very time-consuming.

There are also known vacuum roll mill stands in which a vacuum chamber is adapted solely for the accommodation of workrolls.

The vacuum chamber in the above roll mill stand is relatively small in size, whereas the system of vacuum sealing is rather complicated, especially so in the places at which the workrolls are introduced into the vacuum chamber. The vacuum system is rendered still more complicated and, consequently, less reliable in operation, in view of additional means installed at the roll necks and chocks to compensate for the leakage in the vacuum system due to take place during operation by reason of elastic bending of the workrolls. The changing of rolls is time- and labor-consuming operation, involving complete dismounting and subsequent mounting of the vacuum sealings, which are rather complicated in construction.

Another vacuum roll mill stand known in the prior art comprises a box-shaped housing which accommodates chocks carrying workrolls geared through the intermediary of spindles to a drive. The side walls of the housing are provided with ports for mounting and dismounting the workrolls therethrough. To establish vacuum in the interior of the roll housing, the ports are closed with covers having vacuum seals.

The cover positioned from the side of the mill drive is formed with a cavity adapted to accommodate spindles. The hermetically sealed chamber thus formed is brought in communication with a vacuum pumping means.

In order to perform the roll changing operation in the aforedescribed roll mill stand, it is necessary to remove the covers with vacuum seals, as well as the spindles, chocks and workrolls, and then to carry out the reassembly operation in reverse order, which takes up much time and labour. It particularly holds true for those instances where refractory and hard-to-work metals and alloys are to be rolled with the resultant high rate of wear of the workrolls. This, in turn, demands frequent changing of rolls, the disadvantage adversely affecting production efficiency of a rolling mill.

The roll pass in the prior-art rolling mills is formed by two workrolls. Rolling in such roll passes fails to ensure a favourable reduction schedule necessary for plastic deformation of hard-to-work metals and alloys, which makes it impossible to produce a wide variety of shaped sections from such metals.

SUMMARY OF THE INVENTION

It is an object of the present invention to provide a vacuum roll mill stand of the type permitting workrolls positioned therein to be readily changed in the course of operation.

This object of the invention is accomplished by the provision of a vacuum roll mill stand comprising a housing closed at opposite sides with covers and brought in communication with a vacuum pumping means to thereby form a chamber adapted to accommodate chocks carrying workrolls geared through the intermediary of spindles to a drive, wherein, according to the invention, the chocks with the workrolls are secured on one of the housing covers thereby forming a frame, the housing being annular in shape and arranged so as to have its geometrical axis coincident with the axis of rolling, said housing also being fitted with through openings adapted to receive spindles with vacuum seals.

The roll mill stand is preferably fitted with six openings adapted to receive the spindles, with four of the openings being disposed at an angle of 90 deg. relative to one another and the remaining two openings being disposed at an angle of 120 deg. with respect to one of the four openings.

Such arrangement of the openings in the ring-shaped housing makes it possible, by way of displacing the spindles and corresponding covers with the workrolls, to set a roll pass formed by two, three or four workrolls in the same vacuum roll mill stand depending on the shape of the product to be rolled. This allows for rapid and efficient resetting of the mill stand in rolling small quantity of shaped sections.

The vacuum roll mill stand of the invention permits the roll changing operation to be effected rapidly and efficiently, thereby substantially enhancing production efficiency of the rolling mill. The provision of a multi-roll pass in the mill stand enables the production of high-quality shaped sections from easily oxidizable hard-to-work metals and alloys.

BRIEF DESCRIPTION OF THE DRAWINGS

The invention will be further described, by way of example only, with reference to the accompanying drawings.

DETAILED DESCRIPTION OF THE PREFERRED EMBODIMENT

Figure 1:
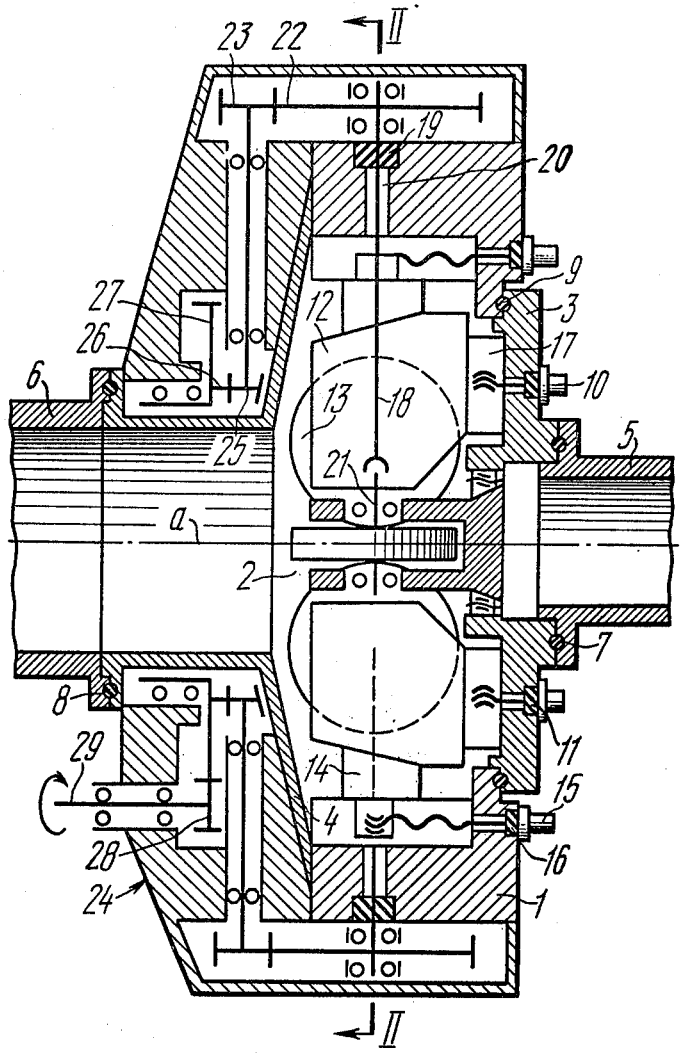
FIG. 1 is a longitudinal sectional view of a vacuum roll mill stand according to the invention.
Figure 2:
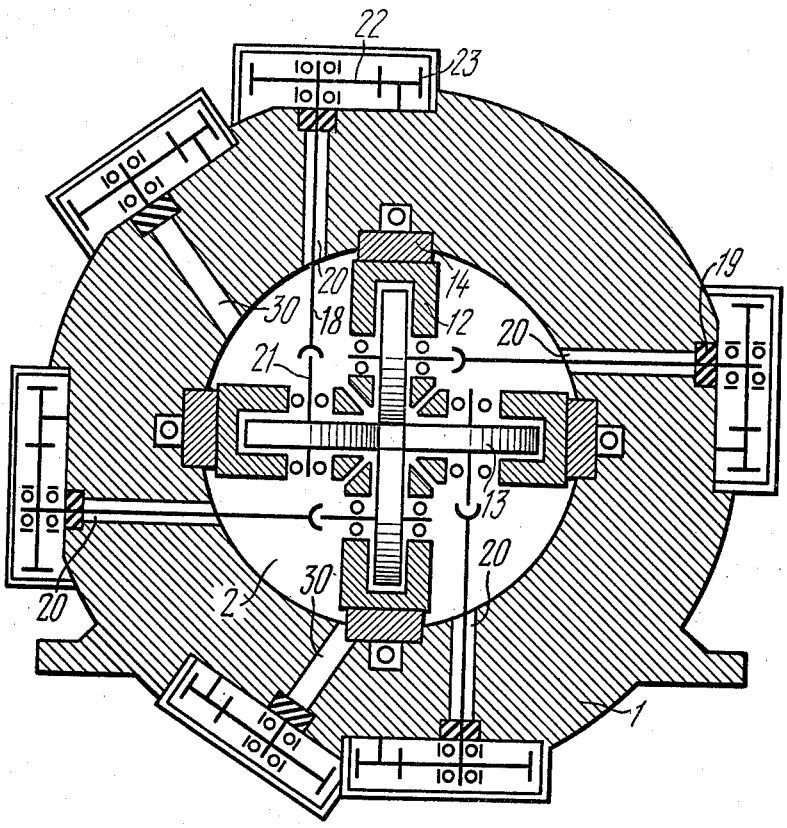
FIG. 2 is a cross-section taken along line II—II of FIG. I.

The vacuum roll mill stand illustrated, to be hereinafter referred to as the stand, comprises a closed ring-shaped housing 1 (FIGS. 1, 2) having its geometrical axis "a" coincident with the axis of rolling. The housing 1 has an inner space 2 and is closed at opposite sides with covers 3 (FIG. 1) and 4. The housing 1 together with the covers 3 and 4 form a chamber brought in communication through connecting pipes 5 and 6 with a vacuum pumping means (not shown). The pipes 5 and 6 are connected to the covers 3 and 4 through vacuum seals 7 and 8 made in the form of vacuum rubber gaskets.

The cover 3 is connected through a vacuum seal 9, formed as a vacuum rubber ring-shaped gasket, with the housing 1 by means of screws uniformly arranged around its periphery. Mounted on the cover 3 by means of screw pairs 10 with vacuum seals 11 are four chocks 12 with workrolls 13, forming a four-roll pass.

Radial adjustment of the workrolls 13 is effected by means of a wedge mechanism 14 with the aid of a screw pair 15 with a vacuum seal 16. Axial adjustment of the workrolls 13 is effected by means of a wedge mechanism 17 with the aid of the screw pair 10 with the vacuum seal 11.

The workrolls 13 are geared to a drive through the intermediary of shafts or spindles 18 provided with vacuum seals 19. The spindles 18 are received in respective openings 20 fitted in the body of the housing 1. The spindles 18 are in splined connection with shafts 21 (FIG. 1) of the workrolls 13.

The spindles 18 are connected with gear wheels 22 enmeshed with gears 23 of a reducer 24 which includes bevel pinions 25, bevel gear 26 in coaxial alignment with cylindrical gear 27, a pinion 28, and a drive shaft 29 which receives torque from an electric motor (not shown).

In the preferred embodiment of the invention, the wall of the body of the distributing reducer 24 serves as the cover 4.

Figure 3:
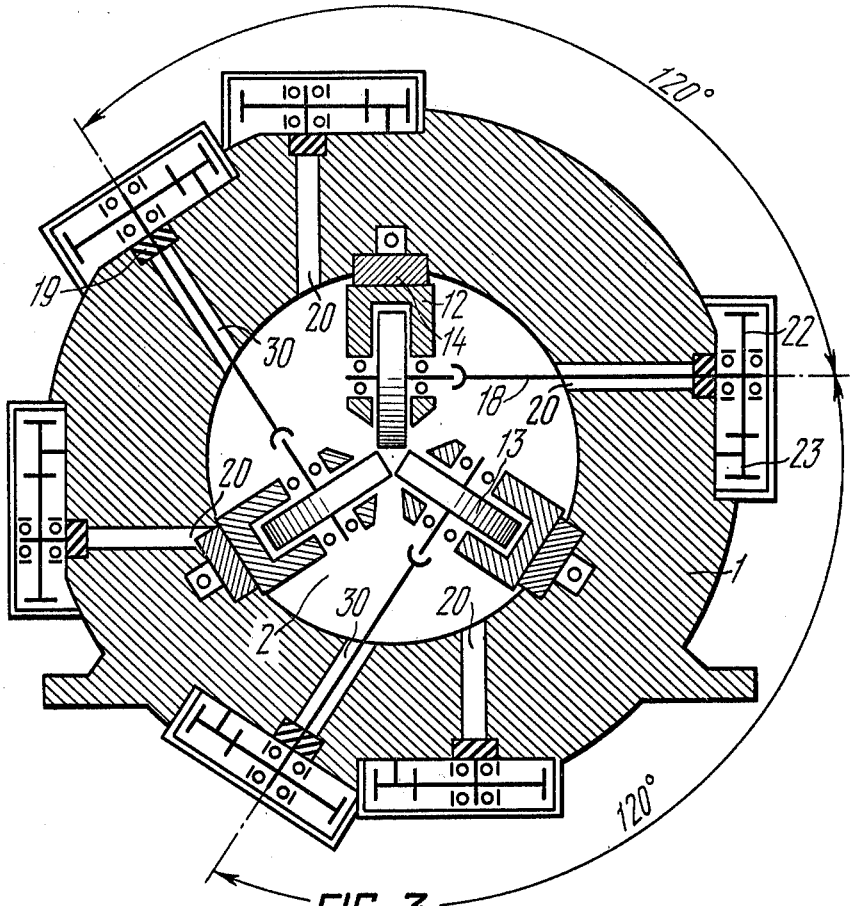
FIG. 3 is a cross sectional view of a mill stand with a three-roll pass.

The housing 1 is fitted with six openings 20, 30 adapted to receive the spindles 18, with the four openings 20 being disposed at an angle of 90 deg. relative to one another and adapted to accommodate a drive of the workrolls 13 forming a four-roll pass. The remaining two openings 30 are positioned at an angle of 120 deg. relative to one of the four openings 20 (FIG. 3) and serve to receive the spindles 18 of the workrolls 13 forming a three-roll pass.

The vacuum roll mill stand according to the invention operates in the following manner.

After the cover 3 with the workrolls 13 is fixedly mounted on the housing 1, the interior of the housing 1 is evacuated. Then, an actuator (not shown) is energized to transmit torque to the shaft 29 which is driven to transmit torque through the pinion 28 to the cylindrical gear 27 coaxially connected with the bevel gear 26 operable to transmit torque to the four bevel pinions 25. The bevel pinions 25 are in coaxial alignment and connection with the cylindrical pinions 23 which ar driven to transmit torque to the cylindrical gears 22. Mounted for axial movement in the cylindrical gears 22, for example, by means of splined connection, are the spindles 18 which transmit torque through the shafts 21 to the workrolls 13. The process of rolling is effected by any conventional method.

To change the workrolls 13, the spindles 18 are axially displaced until their disengagement from the shafts 21 of the workrolls 13. Next, the screws (not shown) used for fixing the cover 3 are undone to permit its removal together with the chocks 12 and workrolls 13. The cover 3 is replaced by a new one with the chocks 12 and workrolls 13 premounted thereon.

Radial displacement of the workrolls 13, necessary for appropriate adjustment of a roll pass, is effected by means of the screw pair 15 which act on the chock 12 through the wedge mechanism 14.

Axial displacement of the workrolls 13 is effected by means of rotating the screw pair 10 operable to act on the chock 12 through the wedge mechanism 17.

With the vacuum roll mill of the invention it becomes possible to carry out the roll changing operation at a substantially higher rate as compared with the prior-art vacuum roll mill stands, which substantially enhances production efficiency of a rolling mill.

The possibility to provide multi-roll passes in the roll mill stand of the invention renders it adaptable for manufacturing shaped sections from easily oxidizable hard-to-work refractory metals and alloys.

What is claimed is:

1. A vacuum roll mill stand comprising: a ring-shaped housing defining an interior having a geometrical central axis substantially coincident with the axis of rolling; a pair of covers removably fixed to respective sides of said housing to close the interior thereof to define a chamber formed by said housing and said covers, said chamber adapted to communicate with a vacuum pumping means; a plurality of chocks mounted on one of said pair of covers so as to be located within said chamber; workrolls forming a roll pass, each of said workrolls being mounted on a respective one of said chocks; said one of said covers on which said chocks are mounted together with said chocks and workrolls forming a frame removably mounted on said housing so that when said frame is removed from said housing said workrolls can be changed when necessary; a plurality of rotatable spindles, each of which is mounted in and extends through respective openings formed in said housing into said chamber and being removably connected to a respective one of said workrolls, each spindle further being mounted in said housing in a manner such that the same are displaceable in the direction of their respective axes upon disconnection thereof from the workrolls to which they are respectively connected in order to facilitate removal of said frame from said housing; drive means coupled to said spindles for rotating the same; and means for vacuum sealing said chamber.

2. A vacuum roll mill stand as claimed in claim 1, wherein the housing is fitted with six openings adapted to receive the spindles, four of said openings being disposed at an angle of 90 deg. relative to one another and the remaining two openings being disposed at an angle of 120 deg. relative to one of said four openings.

3. A vacuum roll mill stand, comprising:

a ring-shaped housing defining an interior having a central axis substantially aligned with the axis of rolling;

cover means sealingly mounted to said housing to close the interior thereof to define a chamber formed by said housing and said cover means;

means for fluidly communicating said chamber with a source of vacuum;

a plurality of chocks, each of which has mounted thereon a respective workroll having an associated shaft, said plurality of chocks being mounted within said chamber on said cover means in a manner such that said workrolls define a multi-roll pass within said chamber; and a plurality of rotatable elongate drive spindles mounted for movement in their respective axial directions, each of said spindles being removably connected at one end to a respective one of said workroll shafts to transmit rotary motion thereto and in a manner such that the spindles are disconnectable from the respective shafts to which they are connected by linear displacement thereof in their respective axial directions.

4. The combination of claim 3 wherein said cover means comprises a pair of covers sealingly mounted to respective sides of said housing, said chocks being mounted on one of said covers, at least said one of said covers to which said chocks are mounted being removably mounted on said housing and a central opening being formed therein, said chocks and workrolls associated therewith being mounted on the interior side of said one of said covers so as to be disposed within said chamber and further including a connecting pipe fixed to the exterior side of said one of said covers in fluid communication with said central opening.

5. The combination of claim 3 wherein six openings are formed through said housing communicating with said chamber defined therein, each of said openings adapted to receive a spindle therein, vacuum seals located within respective ones of said openings to seal the same, four of said openings being disposed at angles of 90° with respect to each other and two of said openings being disposed at an angle of 120° with respect to one of said four openings.

6. The combination of claim 3 wherein each of said spindles is coupled to a respective workroll shaft through a splined joint.

7. The combination of claim 6 wherein each of said shafts is accommodated within a hollow end of a respective spindle and the other end of each spindle is adapted to engage drive means.

* * * * *